United States Patent [19]

Stevenson, IV

[11] Patent Number: 4,474,127

[45] Date of Patent: Oct. 2, 1984

[54] WORKING SAILS AND METHOD FOR FURLING THEM WHILE ALOFT

[76] Inventor: William H. Stevenson, IV, Rte. 5, Box 532, Travelers Rest, Easton, Md. 21601

[21] Appl. No.: 405,865

[22] Filed: Aug. 6, 1982

[51] Int. Cl.[3] ..... B63H 9/10

[52] U.S. Cl. ..... 114/105; 114/104

[58] Field of Search ..... 114/104, 105, 106, 102, 114/103, 39; 52/40; 160/22, 26, 27, 29, 37

[56] References Cited

U.S. PATENT DOCUMENTS 2,595,110 4/1952 Steube et al. ..... 114/104
4,102,289 7/1978 Ebbeson et al. ..... 114/104

FOREIGN PATENT DOCUMENTS 0008560 3/1980 European Pat. Off. .
WO79/00272 5/1979 PCT Int'l Appl. .
14137 of 1908 United Kingdom ..... 114/104
639062 6/1950 United Kingdom ..... 114/106

OTHER PUBLICATIONS

Chutescoop Advertisement, 3-1980.

*Primary Examiner*—Trygve M. Blix
*Assistant Examiner*—Patrick W. Young
*Attorney, Agent, or Firm*—Roylance, Abrams, Berdo & Goodman

[57] ABSTRACT

Working sails are simultaneously furled and bagged by providing at the head of the sail a collapsed bag which is open at its foot end and has two forward edges each slidably attached to, e.g., a bolt rope on a different side of the luff, and by remote operations pulling the bag downwardly to furl the sail from leech to luff and to enclose the furled sail.

15 Claims, 11 Drawing Figures

WORKING SAILS AND METHOD FOR FURLING THEM WHILE ALOFT

The invention relates to working sails and methods for furling them while the sail is aloft.

BACKGROUND OF THE INVENTION

Furling of working sails has historically been accomplished by direct manual manipulation of the sail, requiring that one or more of the crew go forward (in the case of a headsail) or at least out of the cockpit (in the case of a mainsail). Furling of working sails is required under various conditions, including conditions of increasing wind and heavier seas. Furling by direct manual manipulation is at best laborious and often unduly dangerous, especially when furling is required during the changing of sails at sea under heavy weather conditions. Accordingly, prior-art workers have long sought to devise both improved methods and improved sail systems in an effort to overcome the disadvantages of manual furling and changing of sails.

Before the advent of the method and sail system disclosed in my application Ser. No. 139,105, filed Apr. 10, 1980, and now U.S. Pat. No. 4,343,257, prior-art efforts concentrated mainly on furling of headsails and the most successful of the prior-art systems have been those based on the so-called "roller furling" approach, typically disclosed in U.S. patents:

U.S. Pat. No. 3,611,969, Hood
U.S. Pat. No. 3,851,609, Stearn
U.S. Pat. No. 3,964,419, Uecker
U.S. Pat. No. 3,980,036, Crall
U.S. Pat. No. 4,034,694, Dismukes Though roller furling systems achieved rather wide acceptance, they had the disadvantage of requiring mechanical components, including elongated furling members about which the sail is rolled, bearings, special masts, etc., which are not compatible with the normal activities of the sail loft. That disadvantage was overcome by the method and sail system disclosed in my aforementioned application, and the advent of that system has created a demand for other furling systems which require only components compatible with the activities of the sail loft.

OBJECTS OF THE INVENTION

It is accordingly a general object of the invention to devise a method for furling working sails while aloft, and a sail system with which the method can be practiced, without requiring use of heavy, cumbersome or complicated components extraneous to the sail.

Another object is to provide such a method and system which do not require extensive modification of the sail itself.

A further object is to provide such a method and system in which all major components of the system are carried directly by the sail.

SUMMARY OF THE INVENTION

Method embodiments of the invention depend upon provision of a generally tubular bag having a head end, an open foot end, an opening extending longitudinally for the full length of the bag and defining two forward edges, and dimensions when extended adequate to enclose the sail when the sail has been furled, the bag being flexible and capable of being collapsed longitudinally to a collapsed length which is small in comparison to the length of the leading edge of the sail and extended from its longitudinally collapsed condition to a length at least approximately as great as the leading edge of the sail. With the sail aloft and flying, the bag is supported in its longitudinally collapsed condition above the sail, with the open foot end of the bag generally aligned with the head of the sail. The sail is both furled and contained within the bag by pulling the foot end of the bag downwardly to the foot of the sail while constraining the forward edges of the bag to extend each along a line on a different side of the sail adjacent and parallel to the leading edge of the sail, downward movement of the open foot end of the bag causing the foot end of the bag first to embrace a head portion of the sail and then, as downward movement continues, to furl the sail from leech to luff with the portion of the sail so furled being contained by the bag. Advantageously, the two forward edges of the bag are provided with sliders engaged respectively with bolt tapes extending along and secured to the luff tape of the sail. Alternatively, the sliders can be engaged with tracks carried by the mast or other substantially upright support from which the sail is flown.

IDENTIFICATION OF THE DRAWINGS

DETAILED DESCRIPTION OF THE INVENTION

The Embodiment of FIGS. 1–10

Figure 2:
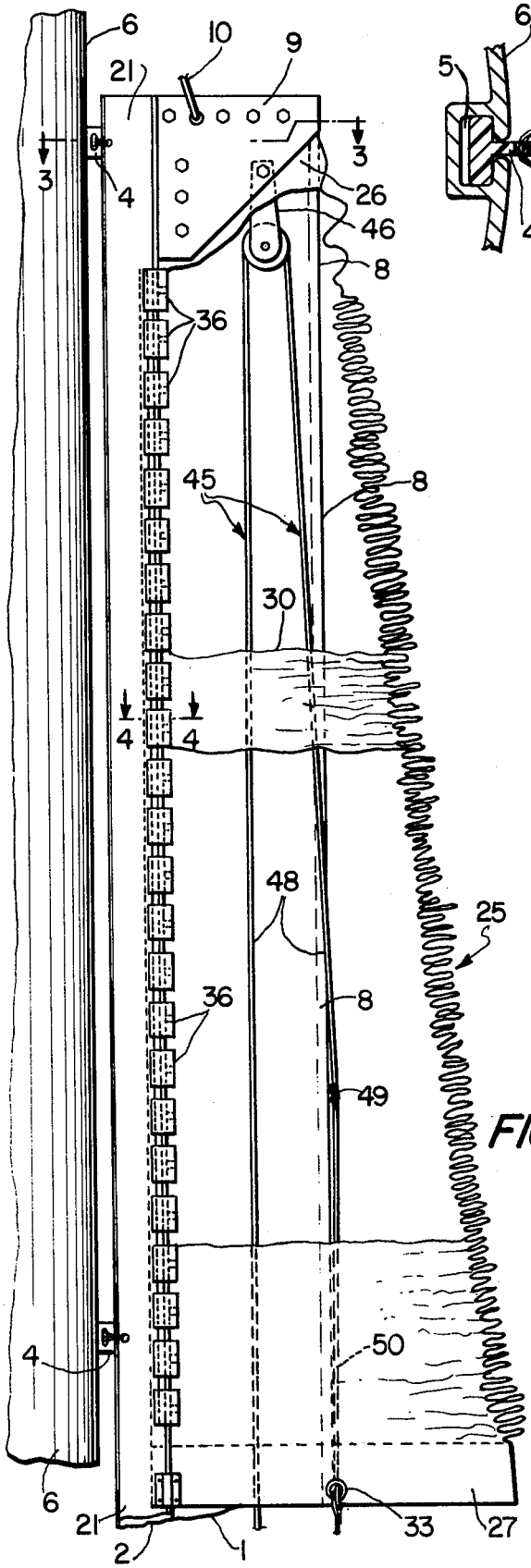
FIG. 2 is a fragmentary side elevational view, enlarged relative to FIG. 1, of a head extension of the sail and the bag in its collapsed condition, portions of the bag being broken away for clarity of illustration.
Figure 3:
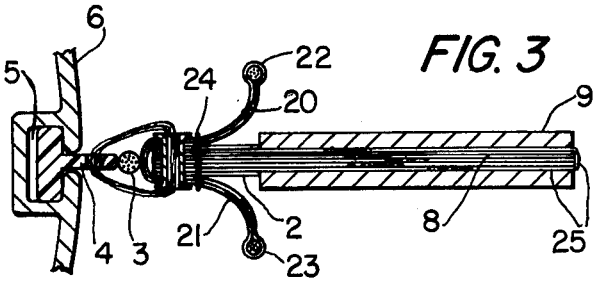
FIG. 3 is a transverse cross-sectional view taken generally on line 3—3, FIG. 2.

Here, the invention is illustrated as applied to a hollow leech, loose-footed mainsail 1 having a luff tape 2 the bight of which is sewed to a relatively heavy bolt rope 3, FIG. 3. A plurality of conventional sliders 4 are spaced along the bolt rope and laced to the luff tape conventionally, the sliders being so constructed and arranged as to be slidably engageable in a longitudinal slot 5 in the mast 6 in usual fashion. Sail 1 is of conventional construction and configuration from reinforced head portion 7 to the foot but, instead of terminating at the reinforced head portion, the head of the sail includes an upward extension 8 to the top of which the head board 9 is secured. Best seen in FIG. 2, head extension 8 is of constant width and of a length which is significant but small in comparison to the total length of the leading edge of the sail. Luff tape 2 and boltrope 3 continue upwardly for the full length of the head extension, one of the sliders 4 being located near the head ends of tape 2 and rope 3. Halyard 10 is connected conventionally to head board 9, run upwardly over a sheave in exit box 11 and thence downwardly through the mast, exiting via exit box 12 to winch 13 and being secured on cleat 14. The tack of the sail is hooked conventionally to boom mount 15 and the foot of the sail is rigged to boom 16 in the manner described in detail in my aforementioned copending application, with the clew connected to a clew slug arranged to travel along the boom so that, when the clew and outhaul line 17 are released, the outhaul line can be manipulated to move the clew to the mast as the sail is furled.

Two bolt tapes 20 and 21 extend for the full length of luff tape 2, each on a different side of the luff tape and with the bolt ropes 22 and 23, respectively, of the two tapes being opposed across the thickness of the luff tape and extending parallel to the leading edge of the sail. In this embodiment, tapes 20, 21 are integral and the midline between the two tapes extends over the bight of the luff tape, as seen in FIG. 3. Bolt tapes 20, 21 are secured to the luff tape throughout the length of the tapes by stitching 24, the line of the stitching being parallel to the leading edge of the sail and located immediately aft of the cringles through which sliders 4 are laced to the luff tape. Thus, a substantial portion of the width of bolt tapes 20, 21 lies aft of stitching 24 and is free to be displaced laterally from the luff tape, so that the bolt tapes can flare outwardly as shown in FIGS. 3 and 4.

Figure 4:
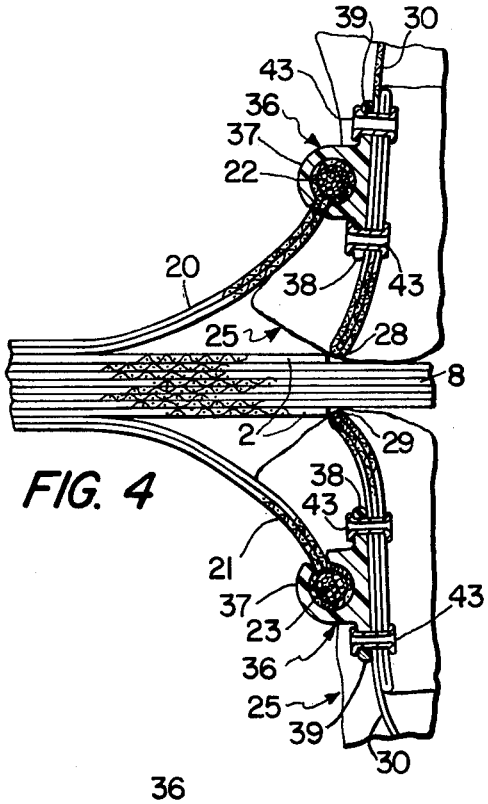
FIG. 4 is a fragmentary transverse cross-sectional view, enlarged relative to FIGS. 2 and 3, taken generally on line 4—4, FIG. 2.
Figure 5:
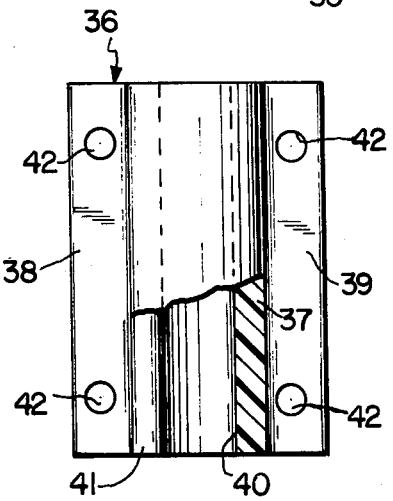
FIG. 5 is a side elevational view, with a portion broken away for clarity of illustration, of a slider employed with the sail of FIG. 1.

For furling sail 1 and containing the sail when furled, the sail is equipped with a generally tubular bag 25 having a head end 26 which is flattened and secured between the two metal plates of head board 9, an open foot end 27, and a longitudinally extending opening providing edges 28 and 29, FIG. 4. Before being secured by the head board, bag 25 is so disposed that edges 28, 29 are disposed each on a different side of the sail and are directed forwardly, the body of the bag extending across the leech of the sail. In this embodiment, the main body of bag 25 is formed from a single thickness 30 of strong but light cloth, typically a sail cloth of 5–9 oz. weight, coated with material resistant to ultra-violet light and the effects of weather. The main body of the bag is, when flattened, in the form of a greatly elongated trapezoid, of the general form shown in FIG. 7, the two long sides of the trapezoid constituting edges 28 and 29, respectively. Thus, when the bag is in its tubular form with forward edges 28, 29 each extending along a different side of the sail and parallel to the leading edge of the sail, the bag tapers from a larger transverse dimension adjacent the foot end to a smaller transverse dimension adjacent the head end and a longitudinal line located midway between edges 28 and 29 will slant downwardly and aft away from the leading edge of the sail when the bag is fully extended longitudinally.

Figure 6:
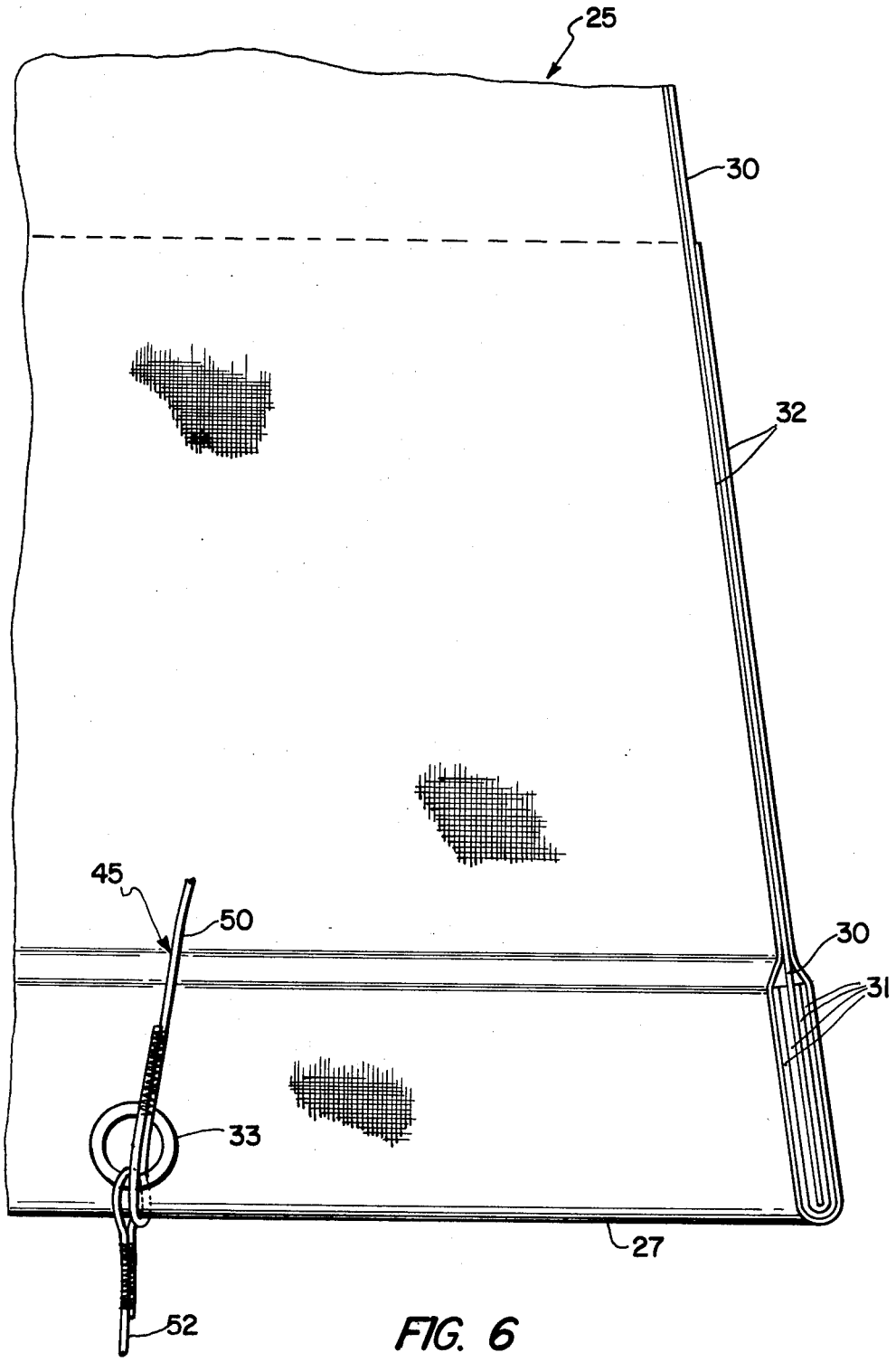
FIG. 6 is an enlarged fragmentary view, partly in vertical cross section and partly in side elevation, of part of the foot end portion of the bag.
Figure 8:
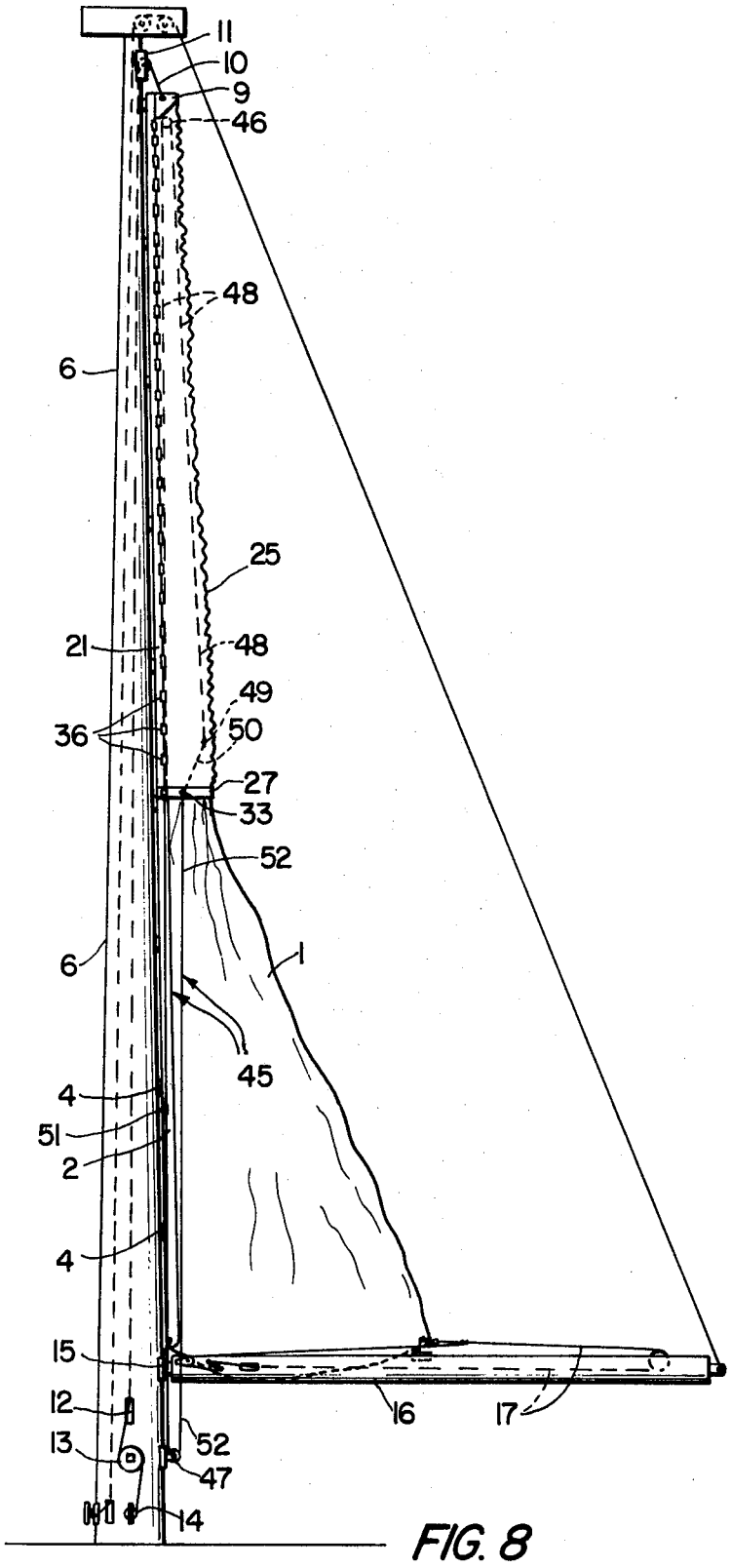
FIGS. 8 and 9 are side elevational views similar to FIG. 1 but showing the sail partially furled and fully furled, respectively.
Figure 7:
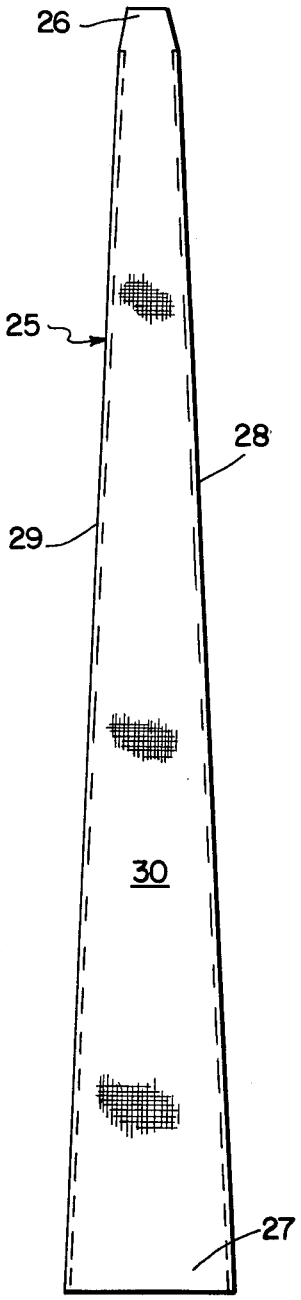
FIG. 7 is a plan view of the body of the bag employed with the sail of FIG. 1, showing the body flattened.

As seen in FIG. 6, the foot end of the bag is stiffened by folding over the foot end of the main body fabric a plurality, typically four or five, of tapes 31 of, e.g., 8 oz. fabric, the fold line and the length of the tapes being parallel to the foot end of fabric 30 and the tapes being secured together and to the fabric of the main body, as by stitching. Since cloth coated with ultra-violet light resistant material has a significant coefficient of friction, the foot end of the bag is covered with a piece of fabric 32 woven from fibers of a material, typically polytetrafluoroethylene, characterized by inherent lubricity. Considering the dimensions when the bag is longitudinally extended, low-friction fabric 32 can extend for two feet or more along the inner surface of the bag, is folded over the edge presented by tapes 31, and can extend for a foot along the outer surface of the bag, fabric 32 being secured to main body fabric 30, as by stitching. Two cringles 33 are secured through the portion of foot end 27 reinforced by tapes 31, the cringles being applied in locations which are opposed diametrically across the bag when the bag is in its tubular form, the locations of the cringles being approximately midway between forward edges 28, 29 and the longitudinal midline of fabric 30.

As best seen in FIG. 4, the material of fabric 30 is folded upon itself along longitudinal lines at edges 28, 29 and the folds secured by stitching, so that edges 28, 29 are each formed by, e.g., three thicknesses of fabric 30. Two groups of mutually identical sliders 36 are provided, the sliders of each group being spaced along and secured to a different edge portion 28, 29. Extruded from polymeric material, each slider 36 comprises an open-ended tubular body portion 37 integral with a base which includes two coplanar mounting flanges 38 and 39 located each on a different side of body portion 37. Body portion 37 defines a right cylindrical through bore 40 interrupted by a slot 41, the slot extending longitudinally, parallel to both the axis of the through bore and the plane of flanges 38, 39, and being open at each end. Slot 41 is defined by rounded edges of body portion 37 and opens into bore 40 along a plane spaced from flange 38. Flanges 38, 39 are each provided with two apertures 42. Each slider 36 is secured to the respective forward edge portion 28, 29 by hollow rivets 43 which extend through apertures 42 and the three layers of fabric of the folded forward edge portion. The sliders 36 of each of the two groups of sliders are secured to the respective edge portion 28, 29 with all of the bores 40 of the sliders of the group coaxial when the corresponding forward edge portion of the bag is stretched longitudinally under tension. The common axis of the bores of the sliders of each group is spaced from the corresponding edge 28, 29 by a distance which is significant but smaller than the width of the trailing portion of the corresponding bolt tape 20, 21 which is aft of stitching 24 and free to flare away from the luff tape.

Figures 1, 11:
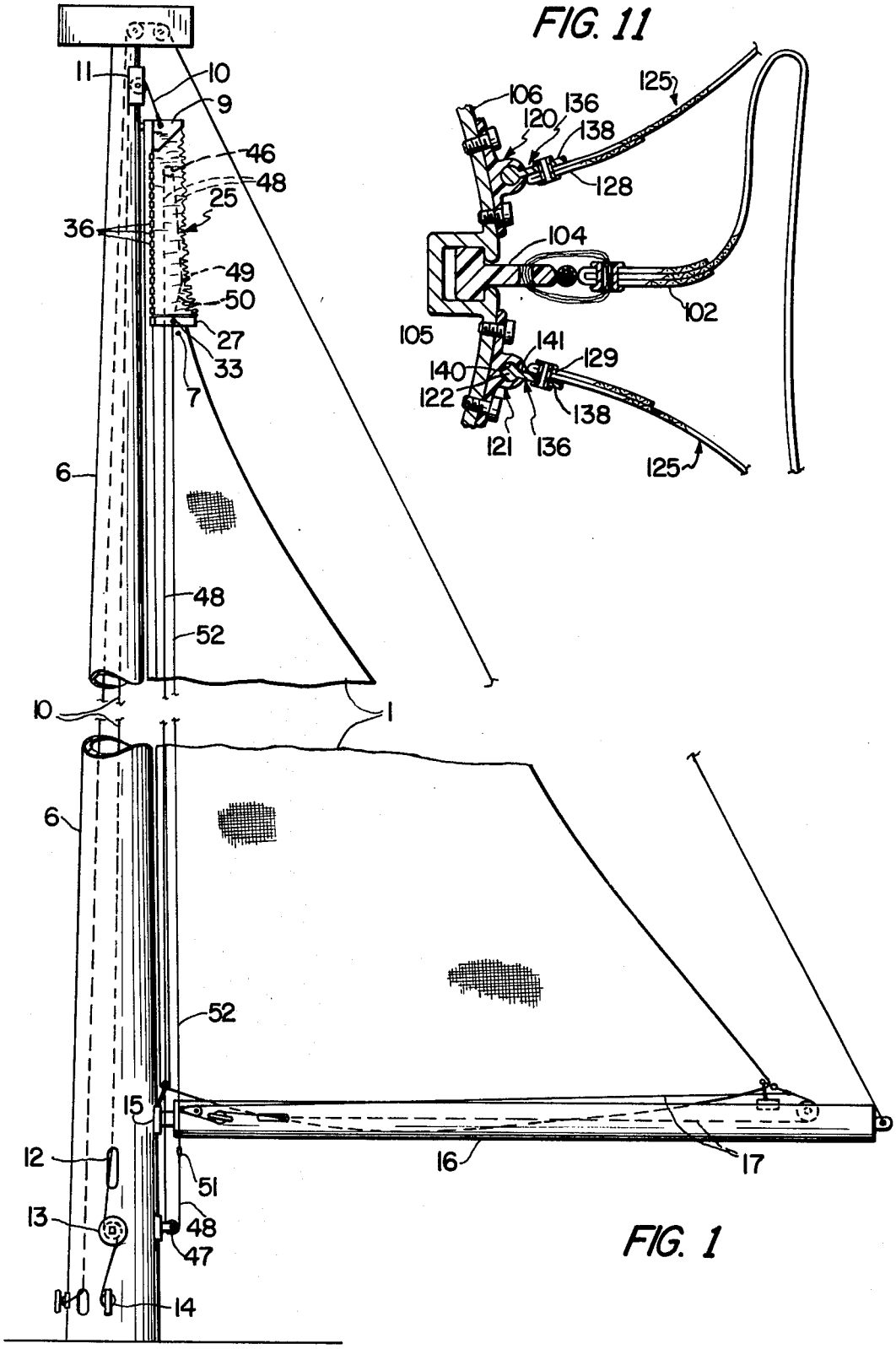
FIG. 1 is a side elevational view of a mainsail according to one embodiment of the invention, with the sail aloft and flying.
FIG. 11 is a fragmentary transverse cross-sectional view similar to FIG. 10 illustrating another embodiment of the invention, the figures being semi-diagrammatic, with fabric thicknesses exaggerated and stitching and conventional parts omitted when too small for clear illustration.
Figure 9:
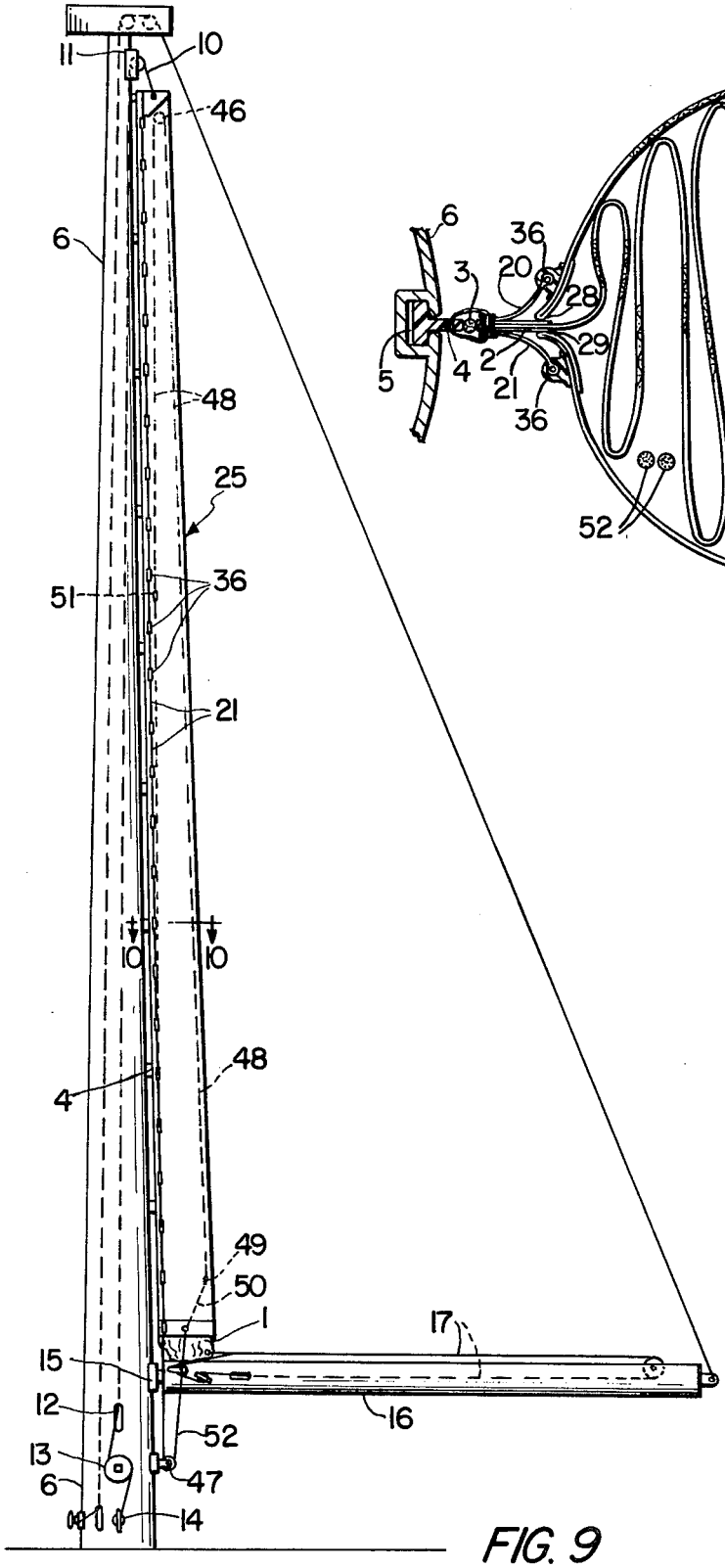
Figure 10:
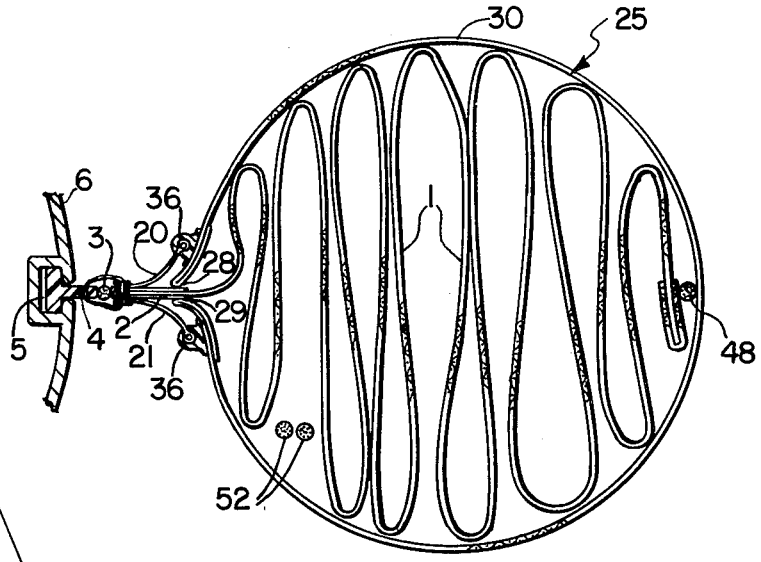
FIG. 10 is a transverse cross-sectional view taken generally on line 10—10, FIG. 9.

As will be apparent by comparison of FIGS. 1 and 9, bag 25 is capable of being collapsed longitudinally to a collapsed length approximately equal to the length of head extension 8, and can be extended longitudinally to a length approximately as great as that of the leading edge of sail 1. The spacing between sliders 36 can be 8–18 in., when the bag is extended to its full length, and the sliders of each adjacent pair are in mutual proximity when the bag is in the collapsed position seen in FIG. 2.

When bag 25 is installed on the sail, the sliders 36 attached to the bag adjacent forward edge 28 are threaded onto bolt tape 20, so that the bolt rope 22 of that tape extends through bores 40 of those sliders, and the sliders attached to the bag adjacent forward edge 29 are similarly threaded onto bolt tape 21, this being done before the metal plates of head board 9 are applied. The forward edges of the bag converge more sharply for the short length of head end 26, and the head end of the bag can therefore be flattened so that, when the metal plates of the head board are bolted in place, the portion of fabric 30 forming head end 26 snugly embraces both sides and the trailing edge of the head end of extension 6 and is clamped and firmly secured by the metal plates of the head board.

So that bag 25 can be collapsed and extended longitudinally from the deck, a line system 45, FIGS. 1, 2 and 6, is provided and extends as a closed loop over an upper sheave 46 at the head board and a lower sheave 47 secured to the mast below the foot of the sail. Sheave 46 is secured by being bolted between one of the metal plates of head board 9 and the corresponding side of head extension 8. Line system 45 includes a portion extending over sheave 46 and made up of a single line 48, one portion of line 48 extending downwardly within bag 25, the end of this portion being spliced at 49, FIG. 2, to two branches 50 each tied through a different one of cringles 33 at the open foot end 27 of the bag. The portion of line 48 running from the other side of sheave 46 extends downwardly through bag 25, exiting through foot end 27 and being spliced at 51 to two lines 52. The length of the portion of the system made up by line 48 and branches 50 is such that the splice at 51 is below the foot of sail 1 when the line system extends over both sheaves 46 and 47 and the bag is in its collapsed condition as in FIGS. 1 and 2. Lines 52 then extend each on a different side of the sail and are each tied to a different one of the cringles 33 at the foot end of the bag.

With bag 25 in its longitudinally collapsed condition at the head of the sail, as in FIGS. 1 and 2, the open foot end of the bag can be hauled downwardly, by a person at the deck near the foot of the mast, simply by grasping first line 48, then lines 52 and pulling downwardly hand-over-hand. Preparatory to downward movement of the bag, the clew and line 17 are released. As the foot end of the bag moves downwardly over the sail, the foot end portion of the bag engages the leech of the sail, and since engagement of sliders 36 with bolt tapes 20, 21 restrains the bag from moving aft, the sail is progressively furled from leech to luff by the foot end portion of the bag. This progressive furling action results because the sliders are engaged with the bolt tapes and that engagement constrains the forward edges 28, 29 to extend along lines, each on a different side of the sail, which are parallel to and just aft of the leading edge of the sail as the bag is extended. As the foot end of the bag moves downwardly, that portion of the sail which has been furled is contained within the bag. Thus furled and bagged, the sail can be left aloft or taken down and stowed, as desired. Assuming the furled and bagged sail to be aloft, the sail can be released to fly simply by manipulating line system 45 to haul the foot end of bag 25 upwardly, returning the bag to the longitudinally collapsed condition at the head of the sail, outhaul line 17 being operated to run the clew to its outer position.

Once sliders 36 have been threaded onto the bolt tapes, bag 25 is maintained in generally tubular form. Accordingly, operation of line system 45 to convert the bag to its longitudinally collapsed form causes the bag to fold in generally accordion fashion, with the folds occurring in a continuous series along the leech but only between adjacent pairs of the sliders along each of forward edges 28, 29. Between each adjacent pair of sliders at each of the forward edges of the bag, the accordion folds open forwardly. However, since covered by bolt tapes 20, 21 in the fashion seen in FIG. 4, these openings are not available to allow entry of wind or air currents into the interior of the bag, and since the bag contains only the flat head extension 8 when the bag is in its longitudinally collapsed condition, airflow caused either by wind or the forward motion of the boat tends only to flatten, not to fill, the collapsed bag. Similarly, when the bag has been fully extended and the sail thus completely furled, as seen in FIG. 9, forward edges 28, 29 of the bag are still covered by the bolt tapes 20, 21 and flowing air again is substantially excluded from entering the bag via the spaces between adjacent sliders 36.

Though FIGS. 1–10 show the invention applied to a mainsail, it will be apparent that, instead of sliders 4, the attachment means attached to the luff tape can be of the type employed to support a headsail from a stay, with no change being required save that the lower sheave of the line means is mounted near the foot of the stay and the line system for manipulating the bag is extended along the deck to the cockpit, generally as described in my aforementioned copending application.

The Embodiment of FIG. 11

In this embodiment, the sail is again a mainsail and is provided with a luff tape 102 attached to the mast 106 in conventional fashion by sliders 104 engaged in mast groove 105. Instead of employing bolt tapes secured to the sail, this embodiment uses two tracks 120 and 121 secured to the mast each on a different side of groove 105. Bag 125 is constructed generally as described with reference to FIGS. 1–9 and includes forward edges 128 and 129. Two groups of sliders 136 are used, the sliders of each group being spaced along and secured to a different one of the forward edge portions of the bag.

Tracks 120, 121 are identical extrusions of metal or rigid polymeric material and extend for the full mast length to be occupied by the sail. In this embodiment, each track defines a longitudinal bore 140 into which opens a longitudinal slot 141. Sliders 136 are mutually identical, each comprising a cylindrical slug 122 and a mounting flange 138, the sliders being secured to the corresponding edge portion of the bag by rivets extending through suitable openings in flange 138 and the layers of the folded edge portion of the bag. The ends of bores 140 of the tracks are open and sliders 136 are engaged with the respective tracks simply by inserting slugs 122 endwise into the bore of the respective track as the sail is installed.

Operation of the embodiment illustrated in FIG. 11 will be apparent from the description for the embodiment of FIGS. 1–10.

What is claimed is:

1. The method for furling a working sail while the sail is aloft and supported along its leading edge, comprising providing a generally tubular bag having a head end, an open foot end, an opening extending longitudinally for the full length of the bag and defining two mutually independent forward edges, and dimensions when extended adequate to enclose the sail when the sail has been furled, the bag being flexible and capable of being collapsed longitudinally to a collapsed length which is small in comparison to the length of the leading edge of the sail and extended from its longitudinally collapsed condition to a length at least approximately as great as the leading edge of the sail;

supporting the bag in its longitudinally collapsed condition above the sail with the open foot end of the bag generally aligned with the head of the sail; and pulling the foot end of the bag downwardly to the foot of the sail while constraining the forward edges of the bag to extend each along a line on a different side of the sail adjacent the leading edge of the sail, downward movement of the foot end of the bag causing the foot end of the bag first to embrace a head portion of the sail and then, as downward movement continues, to furl the sail from leech to luff with the portion of the sail so furled being contained by the bag.

2. The method defined by claim 1, wherein the sail comprises a luff tape extending along the leading edge of the sail; and the forward edges of the bag are constrained to extend each along a line on a different side of the luff tape.

3. The method defined by claim 1, wherein the sail is a mainsail and the leading edge of the sail is connected to a mast along a line extending longitudinally along the mast; and the forward edges of the bag are constrained to extend each along a line extending along the mast on a different side of the leading edge of the sail.

4. In a sail system of the type described, the combination of a working sail of generally triangular configuration including a luff, a leech, a head, a foot, and attachment means whereby the leading edge of the sail can be attached under tension to a generally upright support to hold the sail aloft and flying;

a flexible generally tubular bag having a head end, an open foot end, an opening extending longitudinally for the full length of the bag and defining two mutually independent forward edges, and dimensions when extended adequate to enclose the sail when furled, the bag being capable of being collapsed longitudinally to a collapsed length which is small in comparison to the length of the leading edge of the sail and extended from its longitudinally collapsed condition to a length at least approximately as great as that of the leading edge of the sail;

support means for supporting the bag in its collapsed condition in a location at the head of the sail with the open foot end of the bag generally concentric with the head portion of the sail when the sail is aloft and flying;

line means attached to the foot end of the bag and extending to a location at which the line means can be manipulated to haul the bag downwardly into fully extended position to furl the sail and enclose the furled sail within the bag; and means operatively connected to the forward edges of the bag to constrain the forward edges to extend each along a line parallel to the leading edge of the sail and on a different side of the sail.

5. The combination defined by claim 4, wherein the bag is of fabric resistant to the effects of ultra-violet light and weather;

the open foot end of the bag is defined by a plurality of layers of fabric rendering the wall of the bag at the foot end relatively stiff and form-retaining;

the bag is equipped with two cringles located at points spaced generally cross the open foot end of the bag and extending through said plurality of layers of fabric; and the line means is attached to the bag by line portions extending through the cringles.

6. The combination defined by claim 5, wherein the line means extends between a lower sheave located below the foot of the sail and an upper sheave located above the head of the sail.

7. The combination defined by claim 6, wherein the line means extends as a closed loop with the portion of the line means which depends from the upper sheave extending through the bag.

8. The combination defined by claim 7, wherein the portion of the line means extending over the upper sheave is a single line having a branched end connected to said cringles, and another portion of the line means extending about the lower sheave comprises two lines located each on a different side of the sail.

9. The combination defined by claim 4, wherein the sail comprises a luff tape extending along the leading edge of the sail; and the means connected to the forward edges of the bag to maintain said edges in parallelism with the leading edge of the sail comprises two bolt tapes each extending along and secured to a different side of the luff tape, and being spaced along and secured to a different one of the forward edges of the bag and operatively engaged in sliding relation with a different one of the bolt tapes.

10. The combination defined by claim 9, wherein the sliders are located on the outer surfaces of the bag adjacent the forward edges of the bag, the openings to the interior of the bag defined by the forward edges of the bag being closed by the bolt tapes.

11. The combination defined by claim 4, wherein the sail is a mainsail having a leading edge equipped for attachment to a mast along a first line extending lengthwise of the mast; and the means connected to the forward edges of the bag to maintain said edges in parallelism with the leading edge of the sail comprises two tracks secured to the mast and extending respectively along second and third lines each on a different side of and generally parallel to said first line, and two groups of sliders, the sliders of each group being spaced along and secured to a different one of the forward edges of the bag and operatively engaged in sliding relation with a different one of the tracks.

12. The combination defined by claim 4, wherein the attachment means for the sail comprises an elongated head extension which extends upwardly from a head portion of the sail, a head board at the upper end of the head extension and to which the halyard attaches, and a plurality of attachment devices spaced along and secured to the leading edge of the sail, including the leading edge of the head extension, by which the sail is attached to the generally upright support;

the length of the head extension being at least approximately as great as the length of the bag when the bag is in its longitudinally collapsed condition and the width of the head extension being smaller than the transverse dimension of the bag, the bag when supported in its collapsed condition surrounding the head extension.

13. The combination defined in claim 12, wherein the head end of the bag is flattened and secured to the head board.

14. The combination defined in claim 12, wherein the line means extends as a closed loop and includes a first end portion which runs downwardly through the bag and is attached to the foot end of the bag, and a second end portion which comprises two lines each extending upwardly on a different side of the sail and attached to the foot end of the bag, the first end portion being branched with the two portions of the branch each lying on a different side of the sail and with the junction of the branch being behind the leech.

15. The combination defined by claim 12, wherein the sail comprises a luff tape;

the means connected to the forward edges of the bag to maintain the two forward edges of the bag in parallelism with the leading edge of the sail comprises two bolt tapes each extending along and secured to a different side of the luff tape, and two groups of sliders, the sliders of each group being spaced along and secured to a different one of the forward edges of the bag and operatively engaged in sliding relation with a different one of the bolt tapes, the luff tape and the bolt tapes extending for substantially the full length of the head extension.

* * * * *